US005868592A

United States Patent [19]

Bulin et al.

[11] Patent Number: 5,868,592

[45] Date of Patent: Feb. 9, 1999

[54] SWIM FIN

[75] Inventors: Dennis Bulin, Wesley Chapel; Mark Lee Pecoraro, Zephyrhills; James H. Wittstruck, St. Petersburg, all of Fla.

[73] Assignee: Zeagle Systems, Inc., Fla.

[21] Appl. No.: 854,973

[22] Filed: May 13, 1997

[51] Int. Cl.[6] ..... A63B 31/10

[52] U.S. Cl. ..... 441/64

[58] Field of Search ..... 441/61–64; 114/315; D21/239

[56] References Cited

U.S. PATENT DOCUMENTS

| | | | |
|---|---|---|---|
| 1,007,867 | 11/1911 | Halvorsen | 441/62 |
| 2,343,468 | 3/1944 | Messinger | 441/64 |
| 3,239,857 | 3/1966 | Gwynne | 441/64 |
| 3,952,351 | 4/1976 | Gisbert | 441/62 |
| 4,250,584 | 2/1981 | Korn | 441/62 |
| 4,251,894 | 2/1981 | Hollingsworth | 441/64 |
| 4,795,385 | 1/1989 | Matsuoka | 441/64 |
| 4,889,510 | 12/1989 | Piatt | 441/63 |
| 4,940,437 | 7/1990 | Piatt | 441/62 |
| 5,139,450 | 8/1992 | Steele | 441/64 |
| 5,151,060 | 9/1992 | Lam | 441/62 |
| 5,338,235 | 8/1994 | Lee | 441/60 |
| 5,348,503 | 9/1994 | Fechtner | 441/61 |
| 5,417,599 | 5/1995 | Evans | 441/64 |
| 5,429,536 | 7/1995 | Evans | 441/64 |
| 5,597,336 | 1/1997 | Evans | 441/64 |

*Primary Examiner*—Jesus D. Sotelo
*Attorney, Agent, or Firm*—Stein,Schifino & Van Der Wall

[57] ABSTRACT

A swim fin having open instep and heel portions. The swimmer's foot is retained in the fin by means of an instep strap configured to pass over the instep of the foot and a heel strap that surrounds the heel of the foot. The instep strap passes through a pair of longitudinal slots in the planar foot portion of the fin and up and over the foot such that the ends of the instep strap are secured at the instep. Preferably, to facilitate adjustments, the ends of the instep strap overlap one another and are secured with hook and loop fasteners. A locking strap overlays the instep strap at the instep of the foot and further secures the fin to the foot. The instep strap conforms to the instep of the foot and lends itself to enclasping the arch of the swimmer's foot. Preferably, the heel strap is integrally formed from the instep strap and the ends of which overlap one another are secured with hook and loop fasteners. A heel locking strap overlays the heel strap at the ankle and further secures the fin to the foot.

14 Claims, 12 Drawing Sheets

SWIM FIN

BACKGROUND OF THE INVENTION

1. Field of the Invention

The present invention relates to swim fins. This invention more particularly pertains to a swim fin which foregoes the traditional foot pocket and opts for adjustable straps about the instep and heel of the swimmers foot.

2. Description of the Background Art

Presently, most commercially available swim fins are well known and are in wide use today throughout the scuba industry as well as other water-related industries. Many of these known fins include a closed foot pocket. Most fins which include a closed foot pocket are fabricated with a dual mold operation wherein one mold is used to fabricate the softer foot pocket and the second mold is used to fabricate the sturdy fin portion. The foot pocket is then secured to the sturdy fin portion to form the completed swim fin.

There are numerous problems associated with the fins produced from this dual mold process. The primary problem is that the process is two-part. The process of manufacturing a swim fin can be overwhelmingly simplified by eliminating one or the other of the molds in the traditional dual mold process. Moreover, this known closed foot pocket necessitates having a plurality of swim fins that are capable of accommodating the various sizes of swimmers' feet. Simply, a different sized foot pocket is required for each type of fin. Furthermore, the closed foot pocket is often uncomfortable for the swimmer because of its inability to be properly sized to the swimmer's feet. Often this discomfort may also be as a result of deterioration of the foot pocket or may simply just be as a result of the quality of the materials making up the foot pocket of the swim fin. Consequently, the traditional swim fins of today which include a closed foot pocket are not universally adaptable to every type of swimmer.

An example of a swim fin without a closed foot pocket is that as disclosed in U.S. Pat. No. 5,597,336 to Evans. The patent to Evans teaches a fin having an open instep wherein the fin has upstanding, projecting ear portions. A fastening means fastens across the instep of the swimmer's foot and is secured to the side ear portions of the swim fin. Although this swim fin includes an open instep, it fails to provide a means to completely conform to the instep of the swimmer's foot because the fastening means is secured to the side ear portions rather than the portion of the fin adjacent the sole of the foot. The patent to Evans does not disclose a swim fin as claimed by the present invention.

U.S. Pat. No. 4,940,437 to Piatt also teaches a swim fin without a closed foot pocket. Piatt's swim fin includes an adjustable strap forming an X configuration passing over the wearer's instep and around the wearer's heel. Liner straps are arranged between forward portions of the adjustable strap and the wearer's foot while lateral straps are anchored to the rearward portion of the fin and secured to opposite side portions of the adjustable strap. However, the invention to Piatt does not have the appearance or the quality of construction necessary to become a viable swim fin in the water products industry. Moreover, the patent to Piatt does not disclose the invention as claimed in the present invention.

Moreover, there are examples of devices intended to be used by swimmers which comprise at least a strap about the instep of user's foot. For example, U.S. Pat. Nos. 1,007,867 and 2,343,468 both disclose a device for propelling a swimmer through the water. However, neither disclose a device which may be utilized by numerous types of swimmers having a myriad of sizes of feet. Moreover, neither discloses a device that is capable of prolonged use in a water environment and, at best, would be merely a novelty today. Furthermore, neither device comprises of the structure necessary to both accommodate the narrowest foot and then also prevent lateral movement of that foot relative to the fin. Simply, neither device discloses a swim fin as rigid and with the structurally integrity as the present invention in regards to securing the many different sizes of feet to a swim fin.

Another swim fin of interest is that as disclosed in U.S. Pat. No. 3,239,857 to Gwynne. Gwynne discloses a swim fin having a socket member for receiving a portion of the toes and foot. However, this swim does not provide for the myriad of sizes of swimmers' feet. The Gwynne invention is primarily directed towards utilizing larger leg muscles in the swimmer's leg rather than disclosing to the public a means to provide optimal fit about a swimmer's foot as does the present invention.

In response to the realized inadequacies of these earlier swim fins having closed foot pockets, it became clear that there is a need for an open instep swim fin. This device must provide a conformal instep strap means for securing the fin to the swimmer's foot. Moreover, this device must provide for the multitude of variation in the configurations of a swimmer's foot in a single swim fin while maintaining its effectiveness in propelling the swimmer through the water. In as much as the art consists of various types of swim fins, it can be appreciated that there is a continuing need for and interest in improvements to swim fins, and in this respect, the present invention addresses these needs and interests.

Therefore, the principal object of this invention is to provide an improvement which overcomes the aforementioned inadequacies of the prior art devices and provides an improvement which is a significant contribution to the advancement of the swim fin art.

Another object of this invention is to provide a new and improved swim fin which has all the advantages and none of the disadvantages of the earlier swim fins.

Still another objective of the present invention is to provide a swim fin having open instep and open heel portions which are capable of accommodating the myriad of foot sizes with a single size fin.

Yet another objective of the present invention is to provide a swim fin that appeals to water enthusiasts.

Still a further objective of the present invention is to provide a swim fin that is easily manufactured and assembled.

Yet a further objective is to provide a single mold process for the manufacture of swim fins.

An additional objective is to provide a swim fin with greater comfort.

Another objective is to provide a swim fin comprising, in combination a planar foot portion having an open instep and an open heel portion adapted to receive the human foot, the planar foot portion adjacent the sole of the human foot when the human foot is receive thereon; and conformal strap means coupled to the planar portion for securing the fin to the human foot; the conformal strap means conforming to both the instep and heel of the human foot, the conformal strap means opening at the instep of the human foot to receive the human foot and facilitate adjustments in order to secure the swim fin in place, and the conformal strap means releasably securing the planar foot portion adjacent the sole of the human foot when the human foot is received thereon.

Even yet another objective is to provide a swim fin comprising, in combination a planar foot portion having an open instep and an open heel portion adapted to receive the human foot, the planar foot portion adjacent the sole of the human foot when the human foot is received thereon, the planar foot portion having a pair of longitudinal slots therein; conformal instep strap means comprising an instep strap having opposite ends, the conformal instep strap coupled to the planar portion for securing the fin to the human foot, the conformal instep strap opening at the instep of the human foot to receive the human foot on the planar portion and facilitate adjustments in order to secure the fin in place, the opposite ends of the instep strap to be secured to one another with hook and loop fasteners, the conformal strap releasably securing the planar foot portion adjacent the sole of the human foot and conforming to the instep of the human foot when the human foot is received thereon, the conformal instep strap enclasping the arch of the human foot while encompassing the human foot, the conformal instep strap means further comprising an instep strap and an instep locking means, the instep locking strap having opposite ends adapted to be secured to one another about the instep of the human foot with the locking means, the instep locking strap overlaying the instep strap means, the longitudinal slots configured for receiving the instep strap, the instep strap passing through one of the pair of the longitudinal slots and then through the other of the pair of longitudinal slots; and heel strap means comprising a heel strap, the heel strap integrally formed from the instep strap means for securing the fin to the human foot, the heel strap means further comprising a heel locking strap and a heel locking means for locking the fin to the human foot, the heel locking means coupled between two opposite ends of the heel locking strap, the heel locking strap overlaying the heel strap, the heel strap having two opposite ends opening at the ankle of the human foot to facilitate adjustments, the opposite ends of the heel strap overlapping one another and are secured together with hook and loop fasteners.

The foregoing has outlined some of the pertinent objects of the invention. These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The present invention is defined by the appended claims with the specific embodiments shown in the attached drawings. The present invention is directed to a single-sized swim fin that satisfies the need for an open instep and open heeled fin that may be used by swimmers of many different sizes. For the purpose of summarizing the invention, the invention comprises a conformal instep strap means and heel strap means for securing the fin to the human foot. The instep strap means is coupled to a planar foot portion for underlying the foot of the swimmer. The heel strap means surrounds the heel of the foot and aids in further securing the fin to the human foot.

In the preferred embodiment, the planar foot portion includes a pair of spaced longitudinal slots. These slots are configured such that the instep strap passes from the top through to the bottom and underneath the planar foot portion and back up through the other of the longitudinal slots. The instep strap is secured by having one of the ends of the instep strap layover the top of the other at the instep of the foot and, thus, conform thereto. The securing of instep strap at the instep lends itself to facilitating adjustments of the swim fin about the swimmer's foot. Then a locking strap overlays the instep strap at the instep of the foot and locks down the swim fin to the swimmer's foot.

The heel strap of the present invention operates in a similar fashion. The ends of the heel strap open to receive the human foot and are then secured together by overlapping one another. To further facilitate adjustments, but otherwise provide a secure fit about the swimmer's foot, hook and loop fasteners may be utilized with both the instep and heel strap means.

An important feature of the present invention is that the instep strap means and the heel strap means open completely to receive the foot rather than merely providing a nominal amount of adjustment. Therefore, it can be readily seen that the present invention provides a means to conform to the foot to the maximum extent possible. The proximity of the conformal strap means about the foot lends itself to enclasping the arch of the foot and, thus, secures the swim fin to the swimmer. Thus, an open instep swim fin of the present invention would be greatly appreciated.

The foregoing has outlined rather broadly, the more pertinent and important features of the present invention. The detailed description of the invention that follows is offered so that the present contribution to the art can be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more succinct understanding of the nature and objects of the present invention, reference should be directed to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
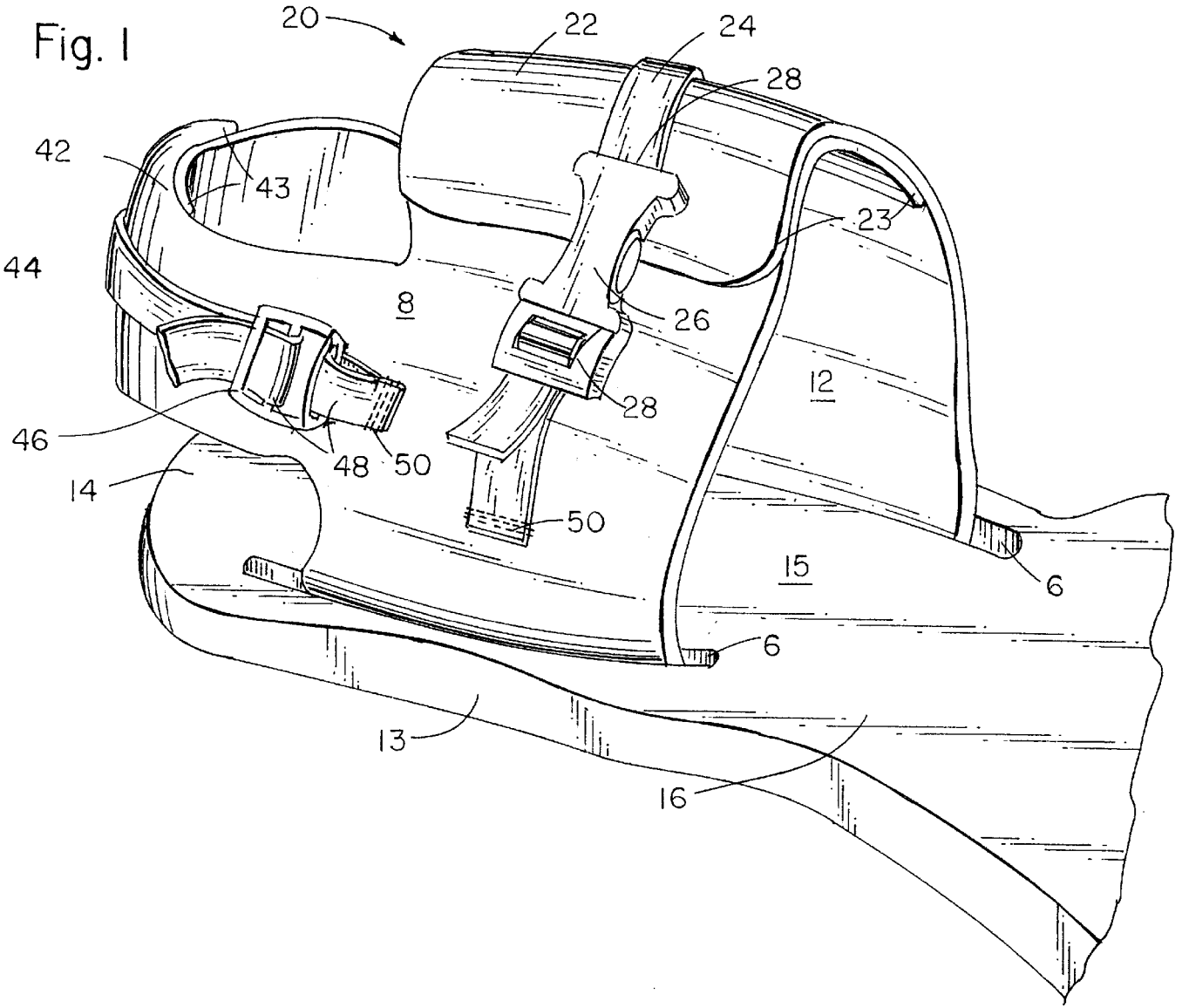
FIG. 1 is a perspective view of the preferred embodiment of the present invention.

With reference to the drawings, and in particular to FIG. 1 thereof, a new and improved swim fin embodying the principles and concepts of the present invention and generally designated by the reference 10 will be described. As shown in FIG. 1, the swim fin of the present invention comprises a planar foot portion 16 with an outer edge 13 and also having an open instep 12 and an open heel portion 14 adapted to receive the human foot. The planar foot portion 16 has a planar foot surface 15 within the outer edge 13 of the planar foot portion 16 and adjacent the sole of the human foot after receiving the human foot. A conformal strap means 20 is coupled to the planar foot portion 16 for securing the fin to the swimmer's foot. The conformal strap means 20 is to conform to both the instep and heel of the foot. The conformal strap means 20 is to open at the instep in order to receive the human foot and facilitate adjustments of the conformal strap means 20 about the foot. The conformal strap means 20 is to releasably secure the planar foot portion 16 adjacent the sole of the human foot when the foot is received in the fin.

Figure 22:
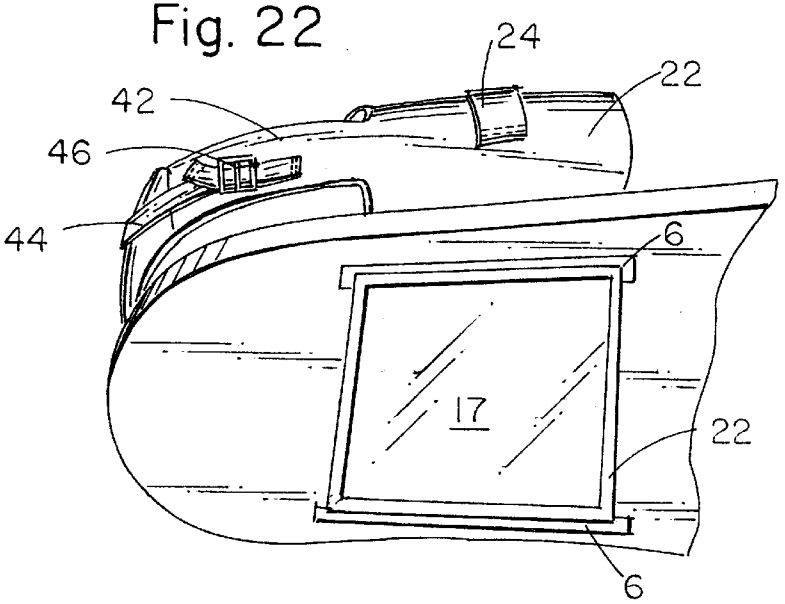
FIG. 22 is the bottom view of the preferred embodiment of the present invention having a durable outsole portion coupled to the instep strap beneath the planar foot portion.

In the preferred embodiment, the conformal strap means comprises an instep strap 22 and a heel strap 42 for securing the fin to the foot. As shown in FIGS. 1–4, the instep strap 22 and the heel strap 42 are integrally formed from one another. Thus, the instep and heel straps 22, 42 are configured to form a boot means 8 for receiving and securing the human foot to the fin. The boot 8 of the present invention is preferable over other known fins because, with the present invention, practically every type of swimmers' foot may be fitted into a single fin while maintaining the structural integrity of the fin necessary to effectively propel the swimmer through the water. For example, the instep strap 22 of the present invention may enclasp the arch of the swimmer's foot and/or the instep strap may completely encompass the human foot. FIGS. 14, 16–18 in combination with FIG. 22 best illustrate the instep strap 22 passing underneath the planar foot portion 16. It is preferred that the planar foot portion include a pair of longitudinal slots 6 which are configured for receiving the instep strap 22 therethrough. The instep strap 22 passes through one of the slots 6, underneath the planar foot portion 16, and back through the other longitudinal slot 6. In order to prevent the portion of the instep strap passing underneath the planar foot portion 16 of the swim fin 10 from becoming worn and deteriorated as a result of use, a durable outsole portion 17 is coupled to the instep strap 22 as shown in FIG. 22.

Figure 17:
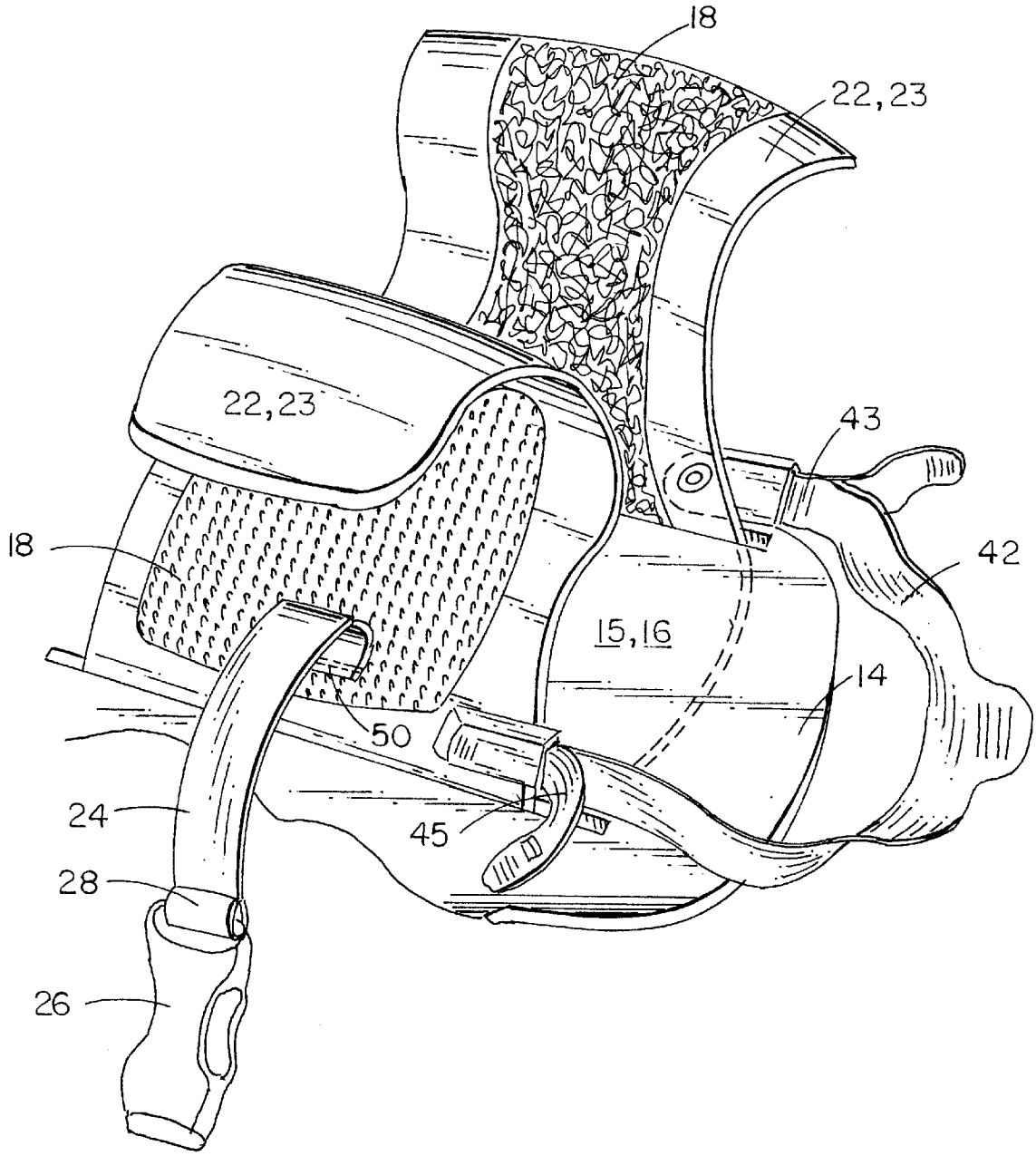
FIG. 17 is an elevated partial view of an alternative embodiment of the present invention wherein the heel strap is coupled to the instep strap.
Figure 18:
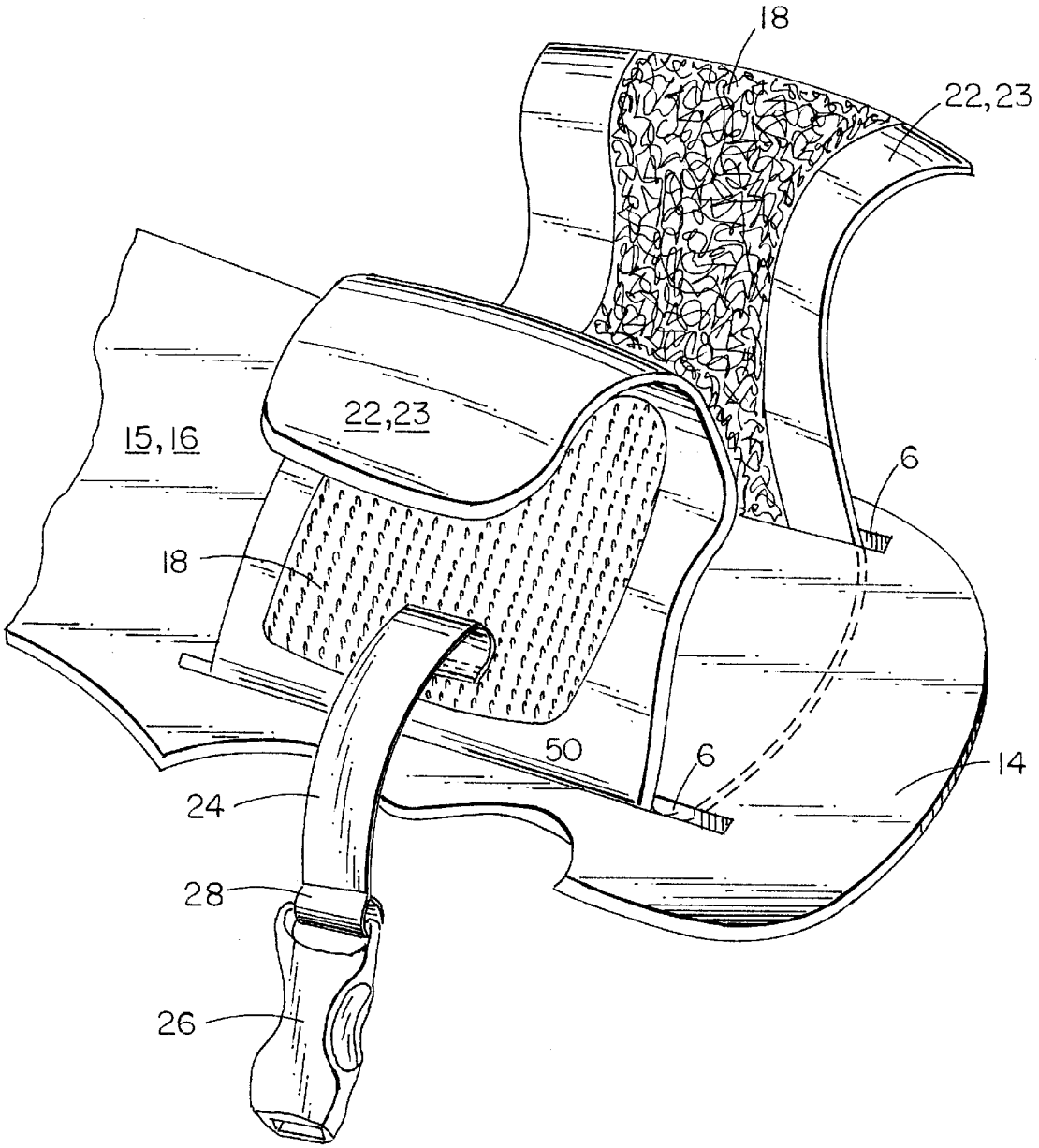
FIG. 18 is an elevated partial view of the instep locking strap stitched to the side of the instep strap.
Figure 19:
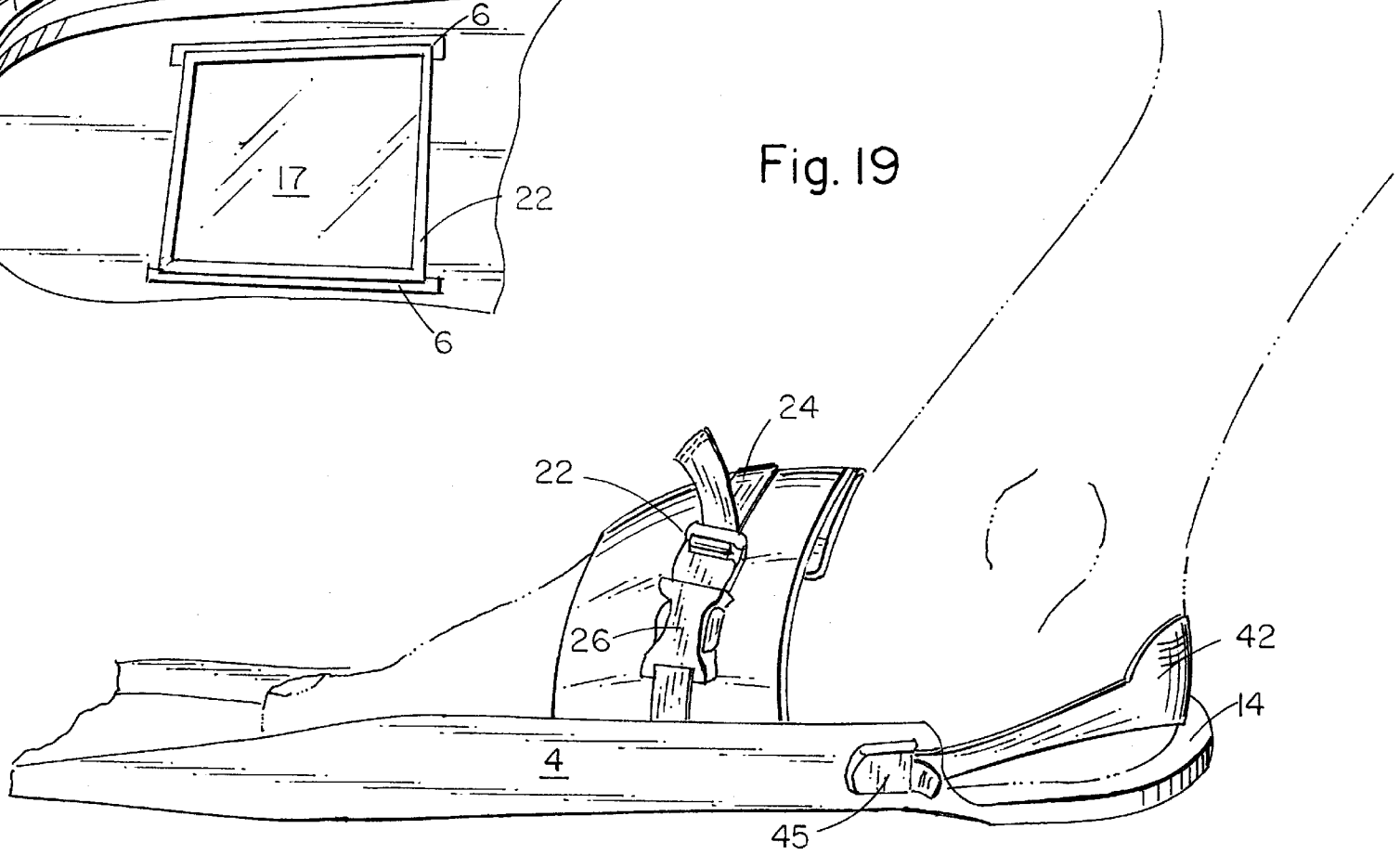
FIG. 19 is side elevation view of the preferred embodiment of the present invention with the swimmer's foot in phantom.
Figure 20:
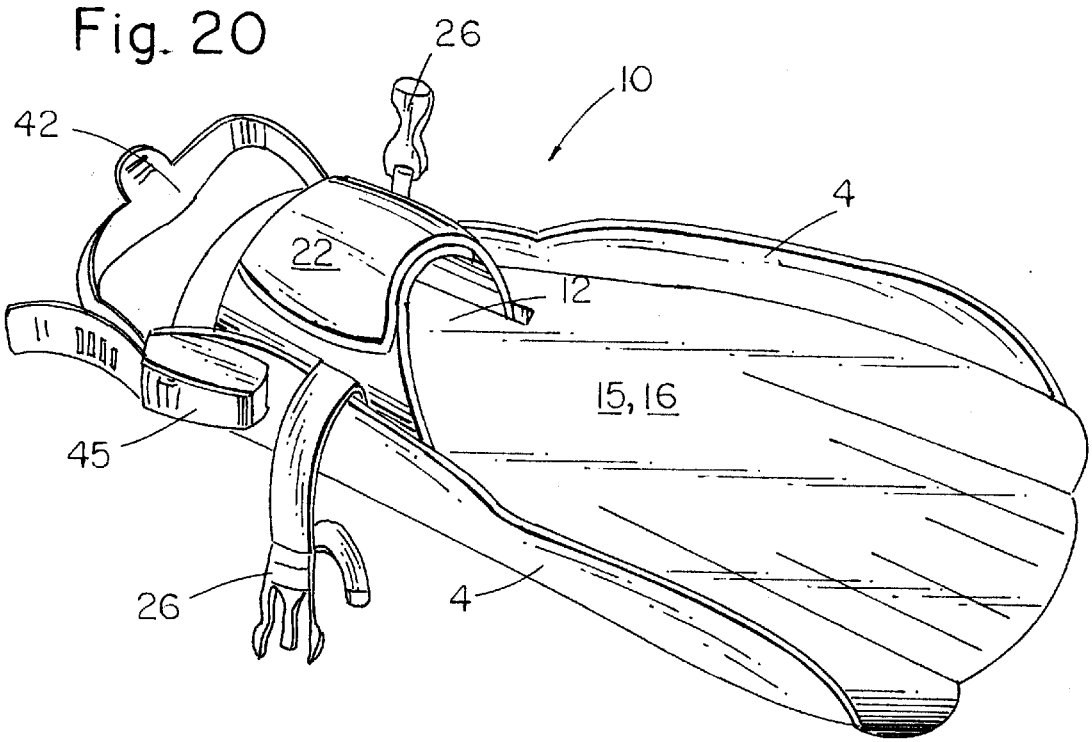
FIG. 20 is an alternative embodiment of the present invention having an industry standard heel strap.
Figure 21:
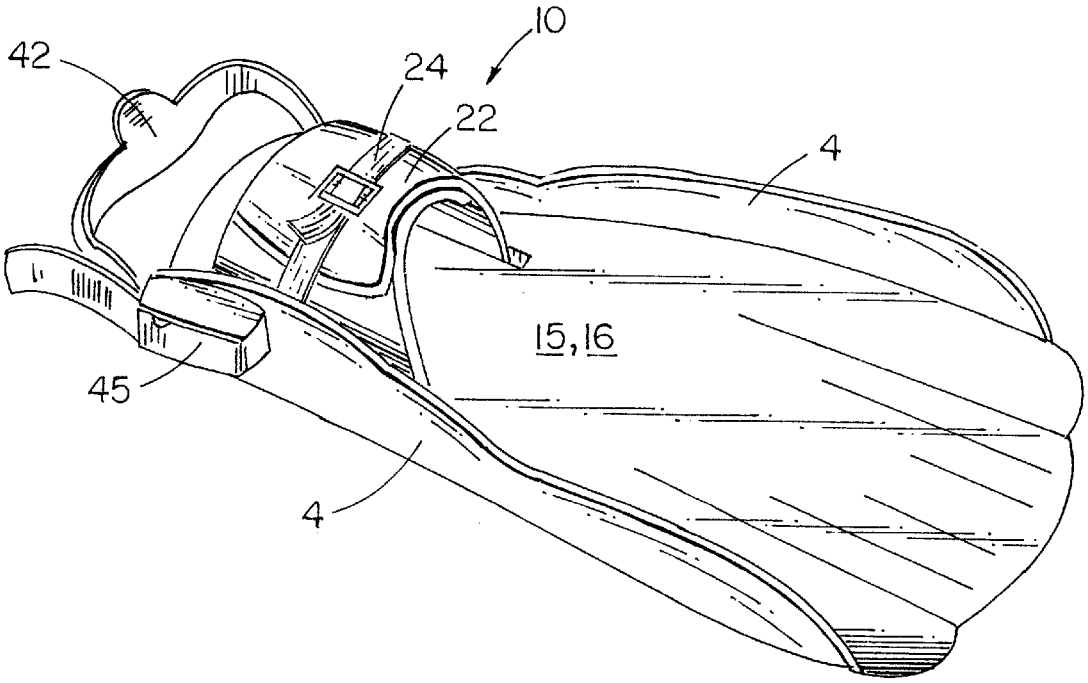
FIG. 21 is an alternative embodiment of the present invention having a buckle for locking down and securing the instep strap about the foot.

Alternatively, the heel strap 42, which may be an industry standard heel strap typically used in conjunction with fins having traditional molded foot pockets, may be coupled to the instep strap 22 as shown in FIG. 17. Moreover, this standard heel strap 42 may be coupled to a pair of side rails 4 integrally formed with the planar foot portion 16 as shown in FIGS. 19–21. These side rails 4 are on opposite sides of the human foot after the foot is received in the swim fin 10. The heel strap 42 has two opposite ends 45, each of which is coupled to the pair of side rails 4 respectively.

Figure 15:
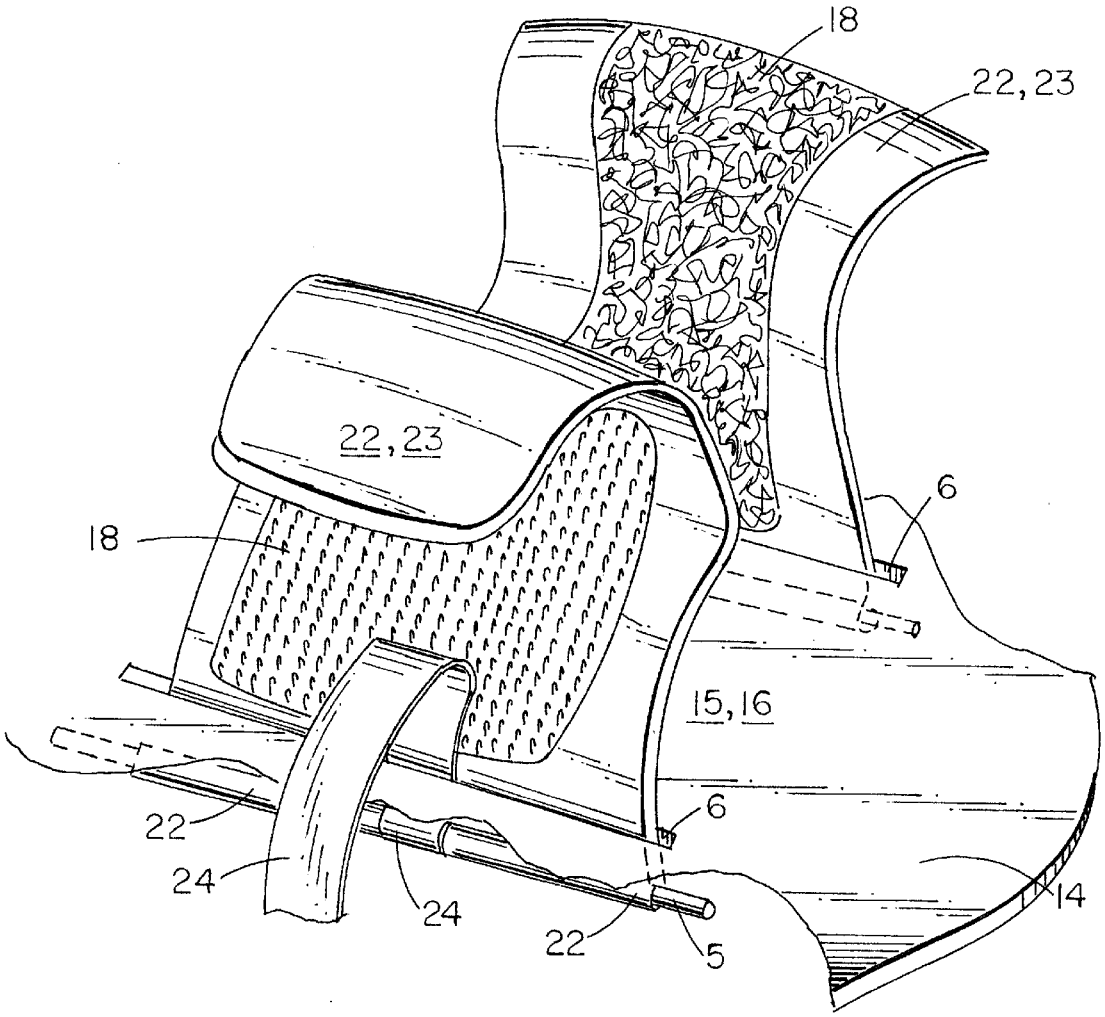
FIG. 15 illustrates an alternative embodiment wherein the instep locking straps are anchored through each of the pair of longitudinal slots.

In an alternative embodiment, the instep strap 22 may pass through the longitudinal slots 6 and be secured to the planar foot portion 16 with an anchor means 5 such as that shown in FIG. 15. In FIG. 15, an elongated rod 5 is preferably longer and wider than the length and width of the longitudinal slots 6.

Figure 12:
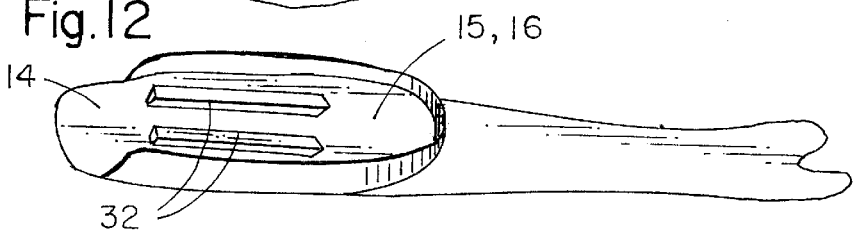
FIGS. 12 and 13 illustrate an alternative means for securing the instep strap to the swim fin wherein the planar foot surface includes a pair of raised tapered dovetails for receiving a pair of tapered grooves respectively in an instep sole portion stitched to the instep strap.
Figure 13:
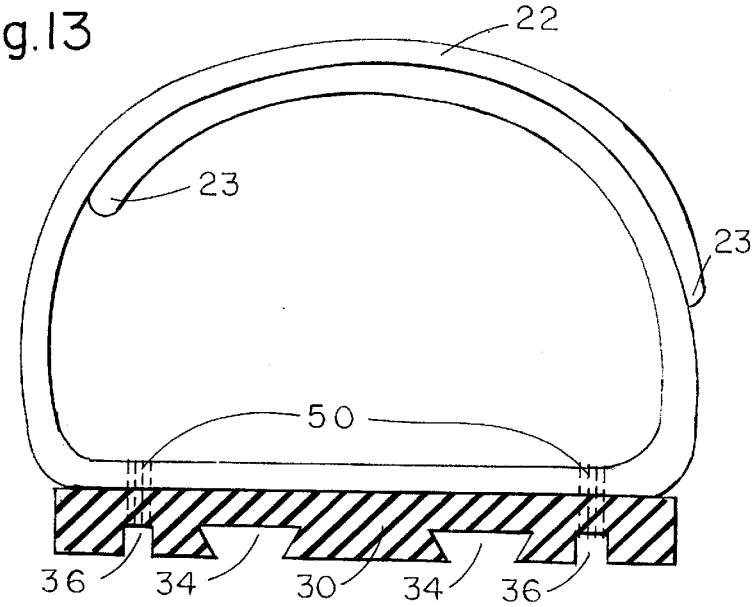

In the present invention there are numerous alternative ways to couple the instep strap 22 to the planar foot portion 16. For example, as shown in FIGS. 12 and 13, the invention may further comprise a sole plate 30 which is to be coupled to the instep strap 22. The planar foot portion 16 would have a pair of spaced, tapered rails 32 and the sole plate would have a pair of spaced, tapered grooves 34 for receiving each of the tapered rails 32 respectively and, thereby, coupling the planar foot portion 16 to the instep strap 22. The sole plate 30 should include a recessed notch 36 to facilitate the instep strap 22 being stitched to the sole plate 30 as well as to facilitate placement of the tapered rail 32 in the tapered grooves 34. FIG. 13, in particular, illustrates the stitching 50 in notch 36.

FIGS. 5 through 11 attempt to further illustrate alternative methods in which to couple the instep strap 22 to the planar foot portion 16 by using fasteners 52 or by looping the instep strap 22 through the planar foot portion 16 and back on to itself.

Figure 2:
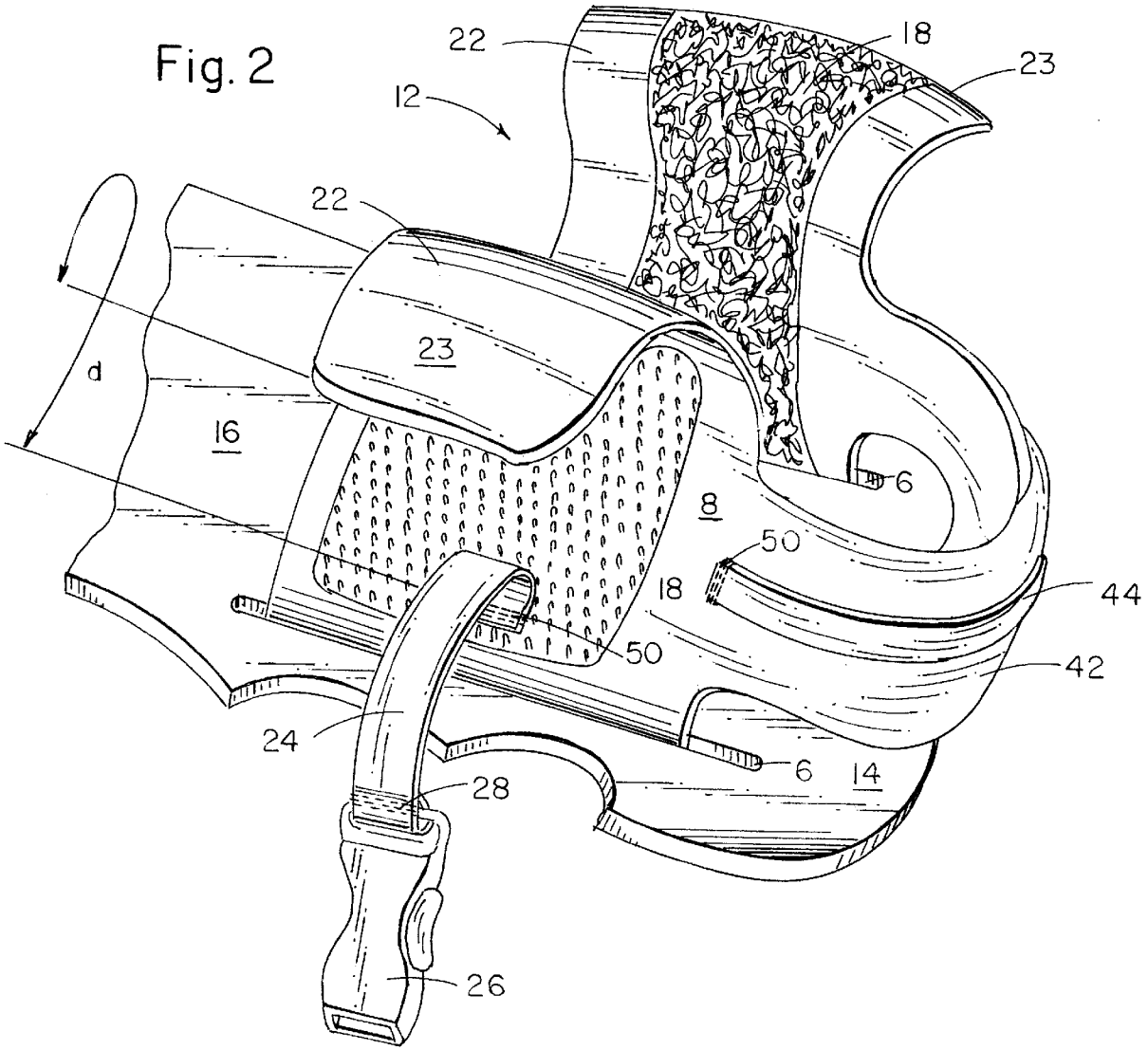
FIG. 2 is a partial elevated view of the left side of the preferred embodiment of the present invention.
Figure 3:
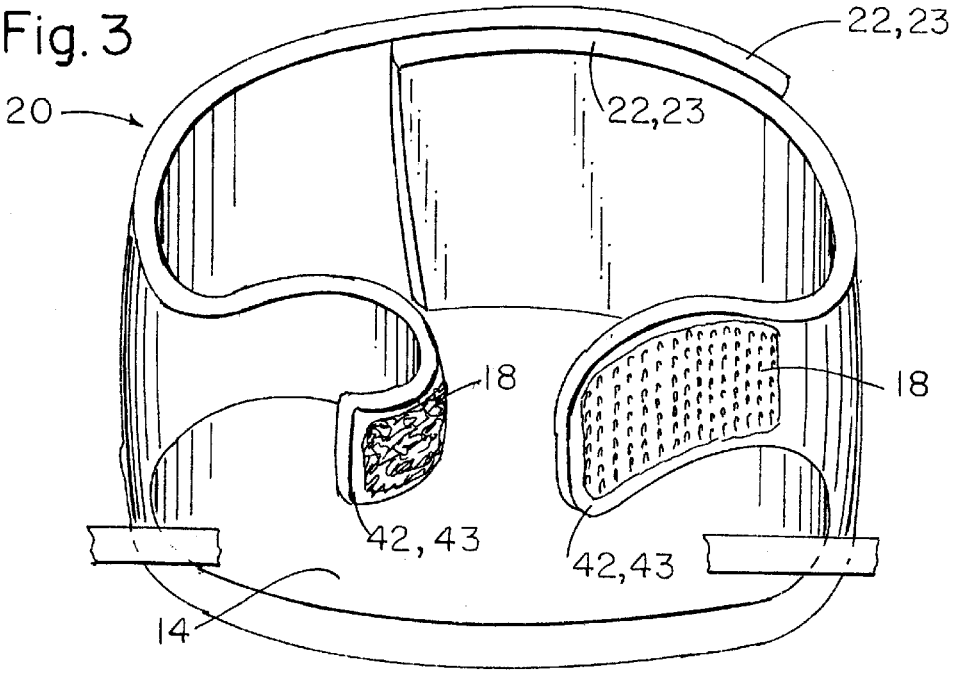
FIG. 3 is a rear view of the preferred embodiment of the present invention having an open heel strap.

Access to the open instep 12 of the swim fin 10 is provided by the instep strap 22 which includes two opposite ends 23 opening at the instep of the human foot to facilitate adjustments in positioning of the foot in the swim fin 10 as shown in FIGS. 2, 5, 14–18. It is preferable that one of the opposite ends 23 of the end strap 22 overlaps the other of the opposite ends 23 as best shown in FIGS. 1, 3, and 13. The opposite ends 23 of the instep strap 22 may be secured together with hook and loop fasteners 18 or any other fastening means which may allow for adjustments in the positioning of the foot as well as provide for the myriad of sizes of swimmers' feet.

It is also preferable that the heel strap 42 of the present invention include two opposite ends 43 opening at the ankle of the human foot to facilitate access and adjustments of the human foot as shown in FIG. 3. As shown in FIGS. 1 and 2, the opposite ends 43 overlap one another and may be secured to each other with hook and loop fasteners 18 in a similar manner as described for the instep strap 22.

Figure 4:
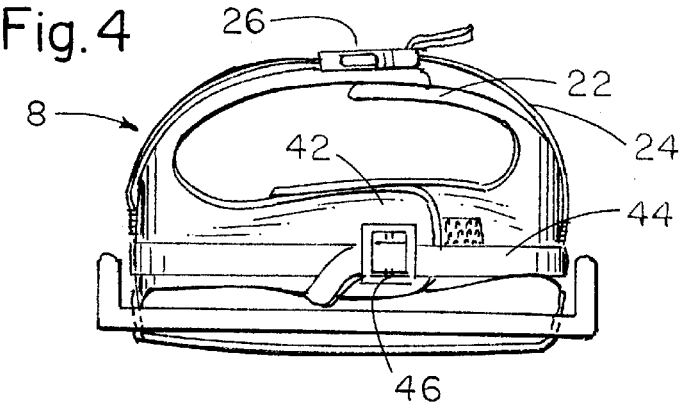
FIG. 4 is a rear view of the present invention having a heel locking strap in a locked position.
Figure 7:
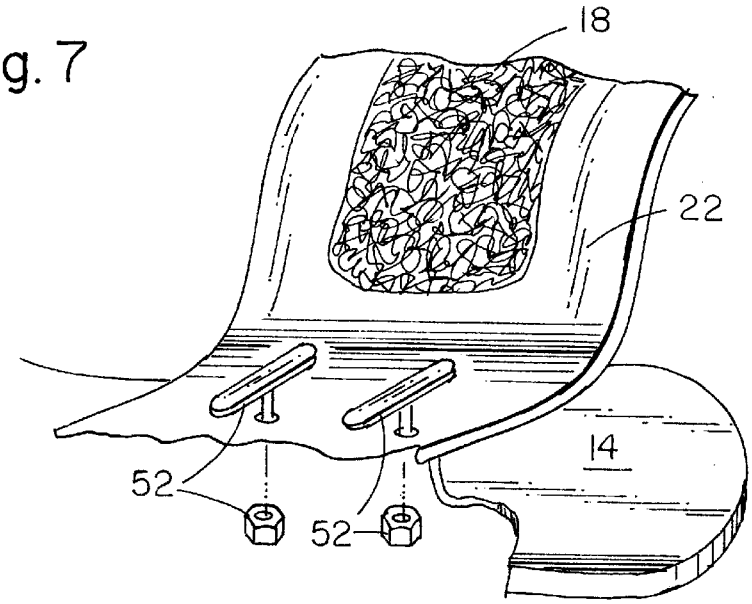
FIG. 7 is a partial elevated view illustrating another alternative fastener.

A preferred feature of the present invention is that the heel strap means comprises a heel locking strap 44 and a heel strap locking means 46 for locking the fin to the human foot and providing additional assurance that the swim fin will conform to the swimmer's foot. The heel strap locking means 46 is coupled between two opposite ends 48 of the heel locking strap. The heel locking strap 44 overlays the heel strap 42 as shown in FIGS. 1, 2, and 4. At the heel of the swim fin 10, it is preferred that the heel strap locking means be a buckle 46 as shown in FIGS. 1, 4 and 22. Alternatively, the heel strap locking means 46 may be a quick-release snap lock 26 as shown in FIGS. 1, 2, 5, 14, 16–20 and described below in regards to the instep strap locking means.

The instep strap means 22 may also comprise an instep locking strap 24 and an instep strap locking means 26 for retaining the form and integrity of the swim fin 10 and, therefore, locking the swim fin 10 about the swimmer's foot. The instep strap locking means 26 is coupled between two opposite ends 28 of the instep locking strap 24. Also, the instep locking strap 24 overlays the instep strap 22 as shown in FIGS. 1, 4, 19, and 21. FIG. 21 also illustrates a buckle 26 as the instep strap locking means 26.

Figure 5:
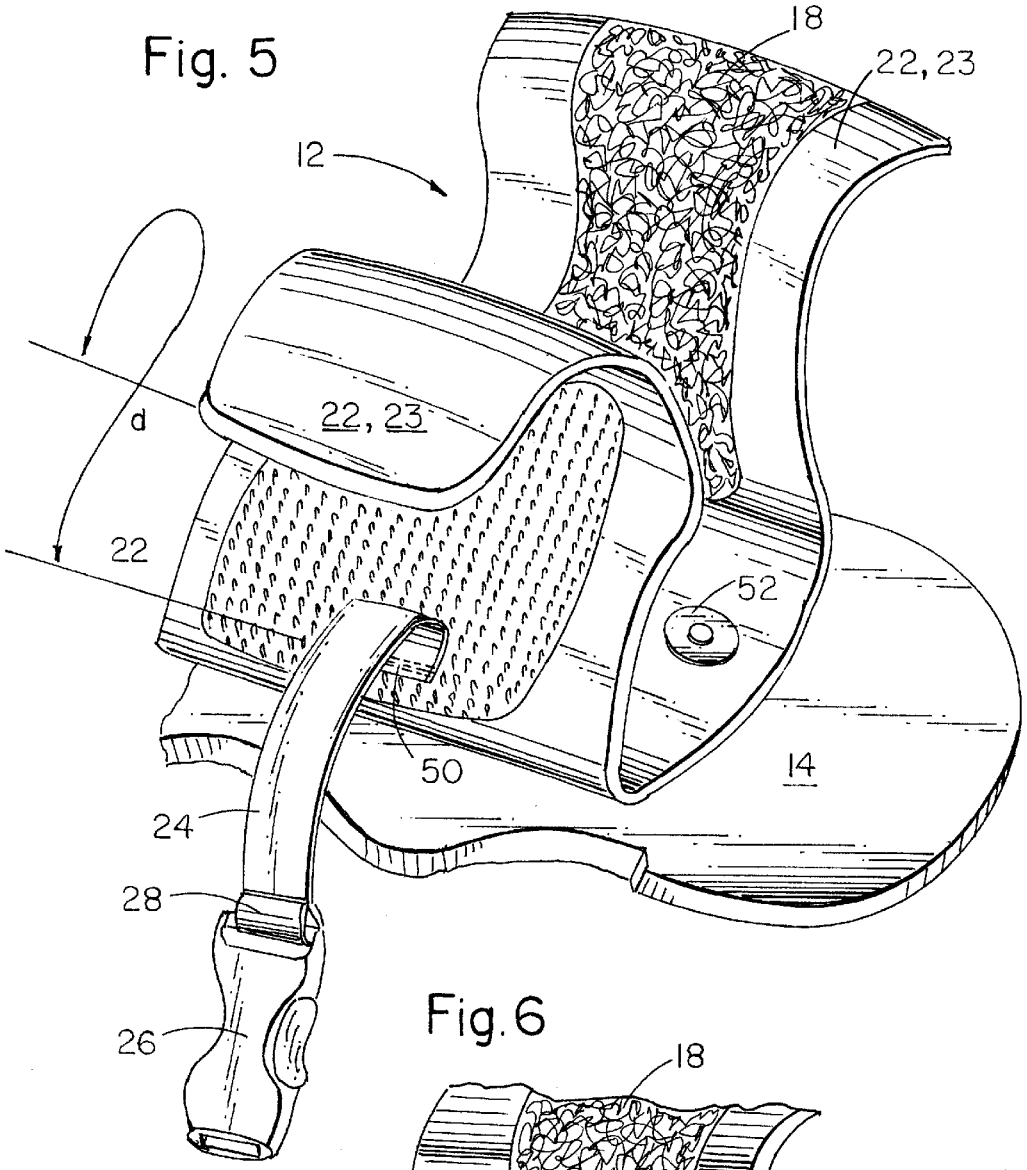
FIG. 5 is an elevated partial view of the left side of the instep strap illustrating the locking strap being secured to each side of the instep strap wherein the instep strap is coupled to the planar foot portion by way of a fastener.
Figure 6:
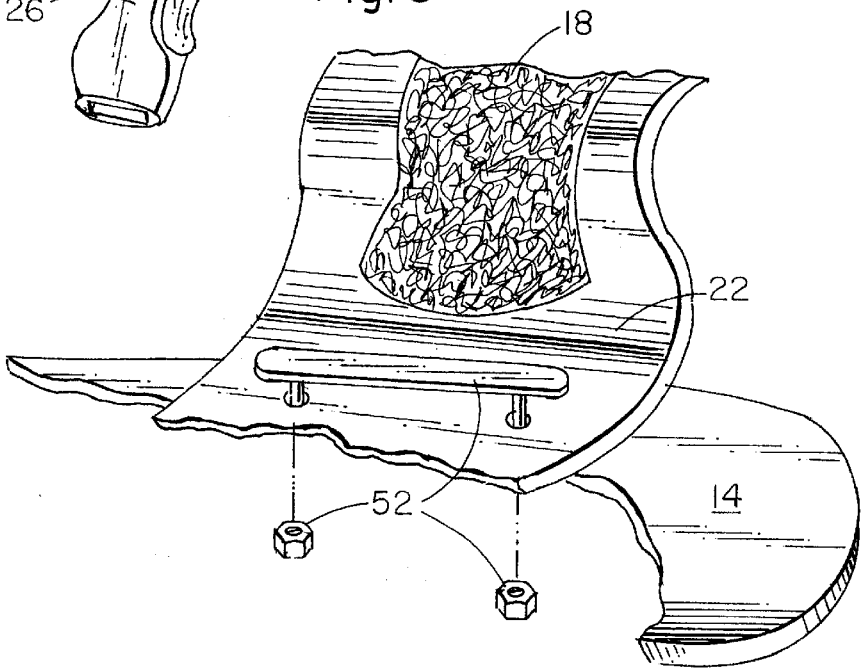
FIG. 6 is a partial elevated view illustrating an alternative fastener.
Figure 8:
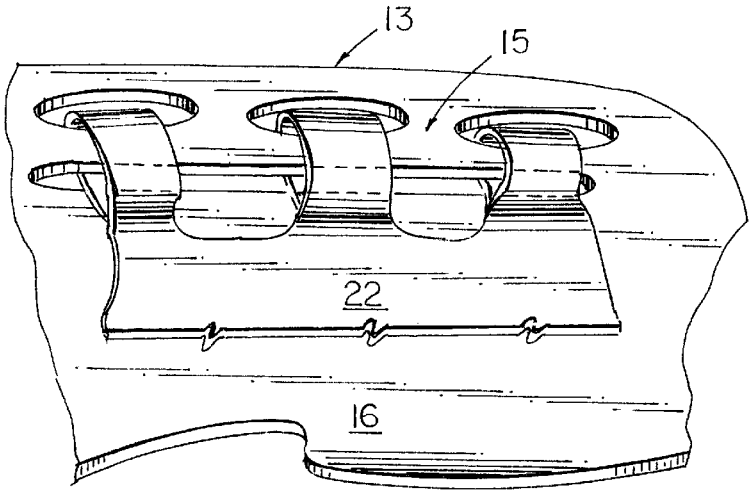
FIG. 8 is a partial elevated view of an alternative means of coupling the instep strap to the planar surface.
Figure 9:
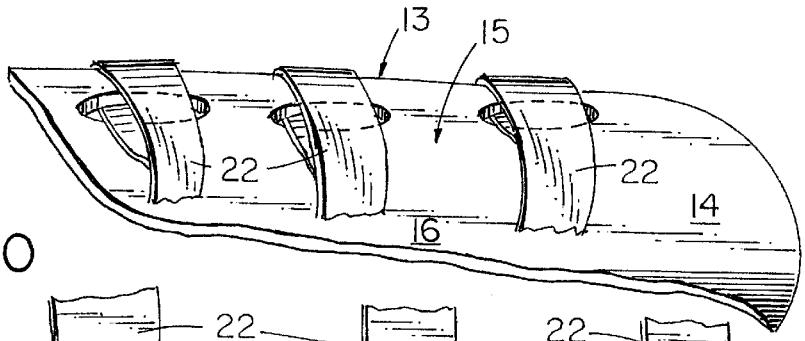
FIG. 9 is a partial elevated view of an alternative means of coupling the instep strap to the planar surface.
Figure 10:
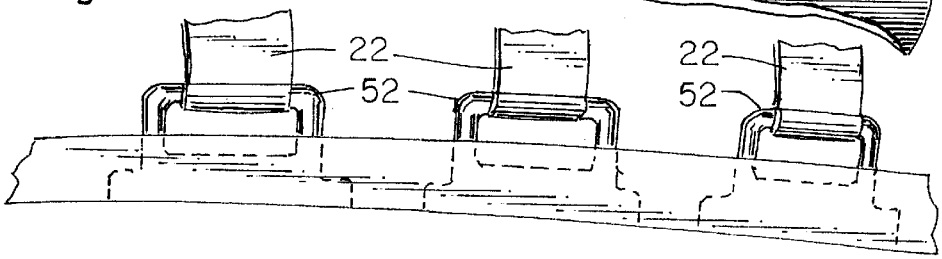
FIG. 10 is a partial elevated view of an alternative means of coupling the instep strap to the planar surface.
Figure 11:
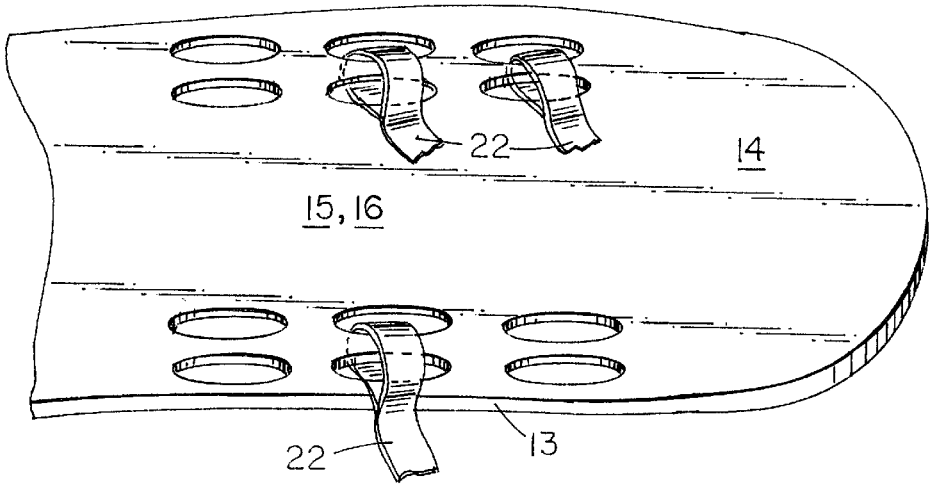
FIG. 11 is a partial elevated view of an alternative means of coupling the instep strap to the planar surface.
Figure 14:
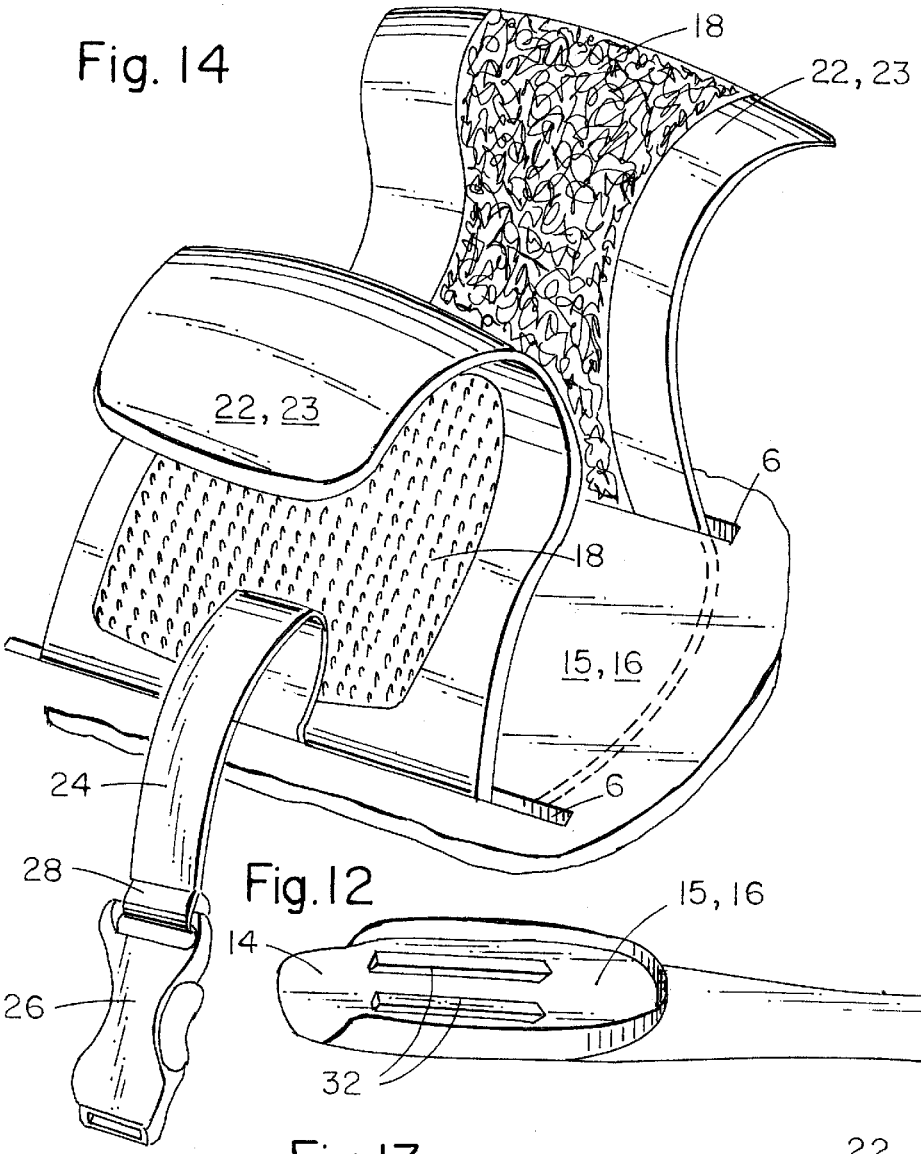
FIG. 14 is an illustration of an alternative embodiment having the instep locking strap passing through the pair of longitudinal slots and under the planar foot portion of the fin as does the instep strap.
Figure 16:
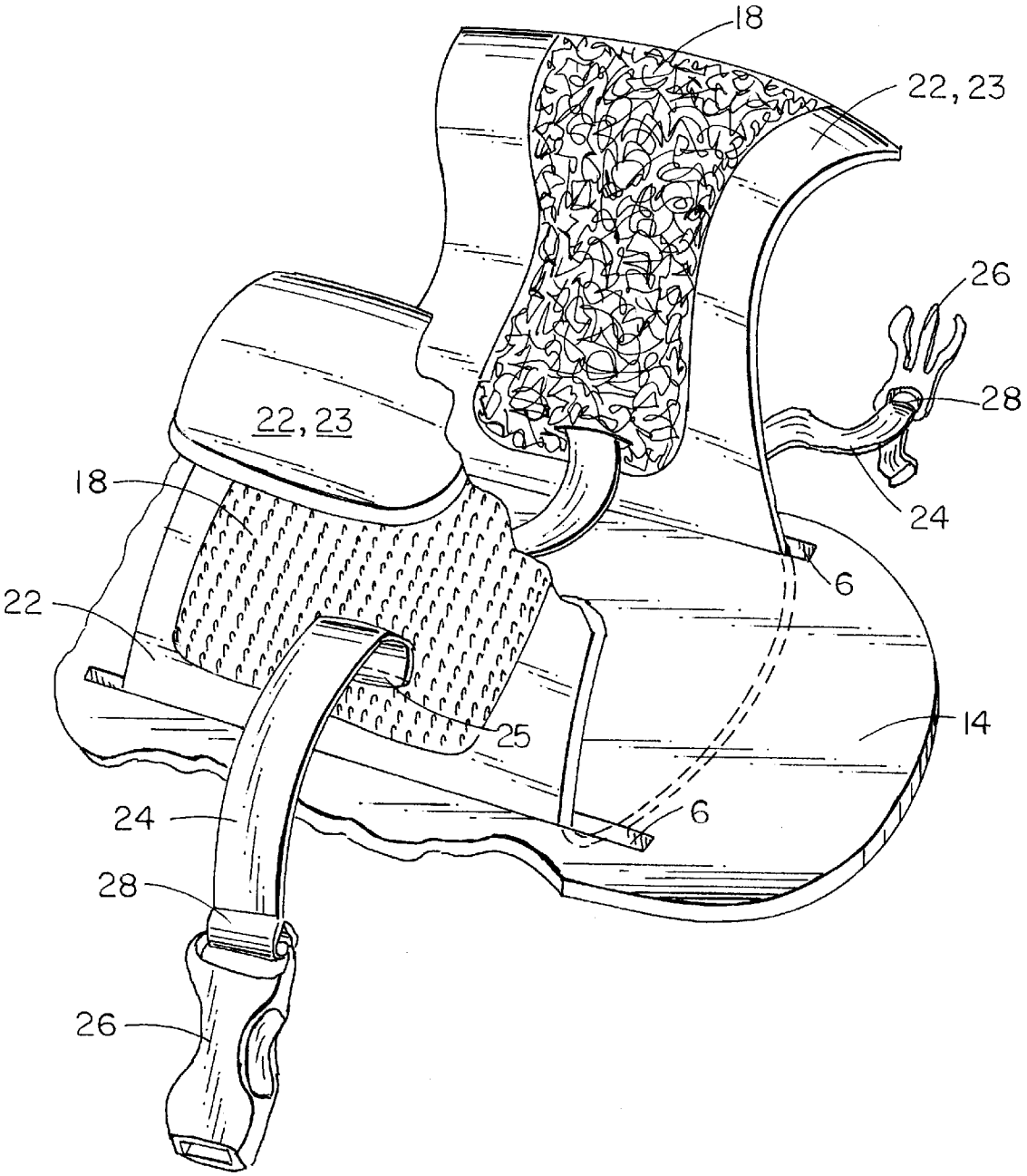
FIG. 16 is an alternative embodiment illustrating the locking strap passing through a pair of spaced apertures in the instep strap.

The instep locking strap 24 may have multiple configurations within the instep strap means 22. For example, the instep locking strap 24 may pass underneath and adjacent the sole of the human foot when the foot is received in the swim fin 10. Each of the opposite ends 28 of the instep locking strap pass to the outside of the instep strap 22 through a pair of spaced apertures 25 in the instep strap 22 as shown in FIG. 16. However, in the preferred embodiment, the instep locking strap 24 is secured to the instep strap 22 with stitching 50 at a distance d away from each opposite end 23 of the instep strap respectively as shown in FIGS. 2 and 5. The distance d should be in the range of 4 to 8 inches from each end 23 of the instep strap 22. Preferably, the instep locking strap 24 should be stitched 50 at a distance d of about 6 inches from the end 23. The distance d allows the ends 23 of the instep strap 22 to properly lay on each other as well as allows for any additional slack in the instep strap 22 within the distance d to be eliminated.

The previously described embodiments of the present invention have many advantages, including providing for a multitude of sizes while firmly securing the fin to the swimmer's foot. Moreover, a single mold process may be utilized instead of the traditional mold process associated with fins having molded foot pockets.

The present disclosure includes that contained in the appended claims, as well as that of the foregoing description. Although this invention has been described in its preferred form with a certain degree of particularity, it should be understood that the present disclosure of the preferred form has been made only by way of example and that numerous changes in the details of construction and the combination and arrangement of parts may be resorted to without departing from the spirit and scope of the invention.

Now that the invention has been described.

What is claimed is:

1. A swim fin comprising, in combination:

a planar foot portion having an open instep and an open heel portion adapted to receive the human foot, said planar foot portion adjacent the sole of the human foot when the human foot is receive thereon;

conformal strap means coupled to said planar foot portion for securing said fin to the human foot, said conformal strap means conforming to both the instep and heel of the human foot, said conformal strap means opening at the instep of the human foot to receive the human foot and facilitate adjustments in order to secure said swim fin in place, said conformal strap means releasably securing said planar foot portion adjacent the sole of the human foot when the human foot is received thereon, said conformal strap means comprising an instep strap means coupled to said planar foot portion, said instep strap means conforming to the instep of the human foot; and a sole plate, said sole plate coupled to said instep strap means, said planar foot portion having a pair of spaced, tapered rails, said sole plate having a pair of spaced, tapered grooves, each of said tapered grooves for receiving each of said tapered rails respectively, thereby coupling said planar foot portion to said instep strap means.

2. The swim fin as claimed in claim 1 wherein the sole plate includes a recessed notch to facilitate said instep strap means being stitched to said sole plate as well as to facilitate placement of said tapered rails in said tapered grooves.

3. A swim fin comprising, in combination:

a planar foot portion having an open instep and an open heel portion adapted to receive the human foot, said planar foot portion adjacent the sole of the human foot when the human foot is receive thereon;

conformal strap means coupled to said planar foot portion for securing said fin to the human foot, said conformal strap means conforming to both the instep and heel of the human foot, said conformal strap means opening at the instep of the human foot to receive the human foot and facilitate adjustments in order to secure said swim fin in place, said conformal strap means releasably securing said planar foot portion adjacent the sole of the human foot when the human foot is received thereon, said conformal strap means comprising an instep strap means coupled to said planar foot portion, said instep strap means conforming to the instep of the human foot, said conformal strap means further comprising a heel strap means coupled to said instep strap means for securing said fin to the human foot, said heel strap means conforming to the heel of the human foot; and said heel strap means comprising a heel strap, a heel locking strap and a heel strap locking means for locking said fin to the human foot, said heel strap locking means being coupled between two opposite ends of said heel locking strap, and said heel locking strap overlaying said heel strap.

4. The swim fin as claimed in claim 3 wherein said heel strap includes two opposite ends opening at the ankle of the human foot to facilitate adjustments.

5. The swim fin as claimed in claim 4 wherein one of said opposite ends of said heel strap overlaps the other, said opposite ends of said heel strap secured to one another with hook and loop fasteners.

6. A swim fin comprising, in combination:

a planar foot portion having an o pen instep and an open heel portion adapted to receive the human foot, said planar foot portion adjacent the sole of the human foot when the human foot is receive thereon;

conformal strap means coupled to said planar foot portion for securing said fin to the human foot, said conformal strap means conforming to both the instep and heel of the human foot, said conformal strap means opening at the instep of the human foot to receive the human foot and facilitate adjustments in order to secure said swim fin in place, said conformal strap means releasably securing said planar foot portion adjacent the sole of the human foot when the human foot is received thereon, said conformal strap means comprising an instep strap means coupled to said planar foot portion, said instep strap means conforming to the instep of the human foot; and said planar foot portion including a pair of longitudinal slots therein, said longitudinal slots being configured for receiving said instep strap means, said instep strap means passing through one of said longitudinal slots, underneath said planar foot portion, and through the other of said longitudinal slots.

7. The swim fin as claimed in claim 6 further comprising a durable outsole portion coupled to said instep strap means beneath said planar foot portion, said durable outsole portion preventing deterioration of said strap means.

8. A swim fin comprising, in combination:

a planar foot portion having an open instep and an open heel portion adapted to receive the human foot, said planar foot portion adjacent the sole of the human foot when the human foot is receive thereon;

conformal strap means coupled to said planar foot portion for securing said fin to the human foot, said conformal strap means conforming to both the instep and heel of the human foot, said conformal strap means opening at the instep of the human foot to receive the human foot and facilitate adjustments in order to secure said swim fin in place, said conformal strap means releasably securing said planar foot portion adjacent the sole of the human foot when the human foot is received thereon, said conformal strap means comprising an instep strap means coupled to said planar foot portion, said instep strap means conforming to the instep of the human foot; and said instep strap means comprising an instep strap, an instep locking strap and an instep strap locking means for locking said fin to the human foot, said instep strap locking means being coupled between two opposite ends of said instep locking strap, and said instep locking strap overlaying said instep strap.

9. The swim fin as claimed in claim wherein said instep strap includes two opposite ends opening at the instep of the human foot to facilitate adjustments.

10. The swim fin as claimed in claim 9 wherein one of said opposite ends of said instep strap overlaps the other, said opposite ends of said instep strap secured to one another with hook and loop fasteners.

11. The swim fin as claimed in claim 8 wherein said instep locking strap is underneath and adjacent the sole of the human foot when the human foot is received in said fin and each of said opposite ends of said instep locking strap passing to the outside of said instep strap through a pair of spaced apertures in said instep strap.

12. The swim fin as claimed in claim 8 wherein said instep locking strap is secured to said instep strap, said instep locking strap secured to said instep strap at a distance away from each said opposite end of said instep strap respectively.

13. A swim fin comprising, in combination:

a planar foot portion having an open instep and an open heel portion adapted to receive the human foot, said planar foot portion adjacent the sole of the human foot when the human foot is receive thereon;

conformal strap means coupled to said planar foot portion for securing said fin to the human foot, said conformal strap means conforming to both the instep and heel of the human foot, said conformal strap means opening at the instep of the human foot to receive the human foot and facilitate adjustments in order to secure said swim fin in place, said conformal strap means releasably securing said planar foot portion adjacent the sole of the human foot when the human foot is received thereon; and said planar foot portion including a pair of longitudinal slots therein, said longitudinal slots being configured for receiving said conformal strap means, said conformal strap means passing through each of said longitudinal slots and securing to said planar foot portion with an anchoring means for anchoring said conformal strap means in said longitudinal slots.

14. A swim fin comprising, in combination: a planar foot portion having an open instep and an open heel portion adapted to receive the human foot, said planar foot portion adjacent the sole of the human foot when the human foot is received thereon, said planar foot portion having a pair of longitudinal slots therein; conformal strap means comprising an instep strap means having opposite ends, said instep strap means coupled to said planar foot portion for securing said fin to the human foot, said conformal strap means opening at the instep of the human foot to receive the human foot on said planar foot portion and facilitate adjustments in order to secure said fin in place, said opposite ends of said instep strap to be secured to one another with hook and loop fasteners, said conformal strap means releasably securing said planar foot portion adjacent the sole of the human foot and conforming to the instep of the human foot when the human foot is received thereon, said instep strap means enclasping the arch of the human foot while encompassing the human foot, said instep strap means further comprising an instep strap and an instep strap locking means, said instep locking strap having opposite ends adapted to be secured to one another about the instep of the human foot with said instep strap locking means, said instep locking strap overlaying said instep strap means, said longitudinal slots configured for receiving said instep strap, said instep strap passing through one of said pair of said longitudinal slots and then through the other of said pair of longitudinal slots; and heel strap means comprising a heel strap, said heel strap and said instep strap means integrally formed from one another to form a boot means for receiving and securing said fin to the human foot, said heel strap means further comprising a heel locking strap and a heel locking means for locking said fin to the human foot, said heel locking means coupled between two opposite ends of said heel locking strap, said heel locking strap overlaying said heel strap, said heel strap having two opposite ends opening at the ankle of the human foot to facilitate adjustments, said opposite ends of said heel strap overlapping one another and secured together with hook and loop fasteners.

* * * * *